US008201503B2

(12) United States Patent
Huppert et al.

(10) Patent No.: US 8,201,503 B2
(45) Date of Patent: Jun. 19, 2012

(54) RAILROAD CAR DIAPHRAGM

(75) Inventors: Douglas A. Huppert, Baltimore, MD (US); Terry B. Soesbee, Columbia, MD (US); Timothy V. Treadwell, Perry Hall, MD (US)

(73) Assignee: RailPlan International, Inc., Baltimore, MD (US)

( * ) Notice: Subject to any disclaimer, the term of this patent is extended or adjusted under 35 U.S.C. 154(b) by 239 days.

(21) Appl. No.: 12/694,625

(22) Filed: Jan. 27, 2010

(65) Prior Publication Data

US 2010/0212538 A1 Aug. 26, 2010

Related U.S. Application Data

(60) Provisional application No. 61/147,898, filed on Jan. 28, 2009.

(51) Int. Cl.
*B60D 5/00* (2006.01)

(52) U.S. Cl. ..... 105/15; 105/21; 280/403

(58) Field of Classification Search ..... 105/15–21; 280/403

See application file for complete search history.

(56) References Cited

U.S. PATENT DOCUMENTS 4,599,947 A 7/1986 Keefer
4,765,249 A * 8/1988 Ishizuka et al. ..... 105/10
4,984,522 A 1/1991 Parish

OTHER PUBLICATIONS

Drawing DAH 102105, Rev. 0 "Bellows Design Concept Amfleet Coach Amtrak" dated Mar. 7, 2006.
Drawing DAH 102105, Rev. 1 "Assembly, Gangway Anfleet Coach Amtrak" dated May 23, 2007.

* cited by examiner

*Primary Examiner* — S. Joseph Morano
*Assistant Examiner* — R. J. McCarry, Jr.
(74) *Attorney, Agent, or Firm* — DLA Piper LLP (US)

(57) ABSTRACT

A railcar diaphragm is described having a first and a second plate assembly, a bellows assembly, and a spring assembly. The first plate assembly is coupled to a railcar. The second plate assembly is configured to contact another railcar. The bellows is disposed between first and second plate assemblies. The spring assembly includes a leaf spring and a pivot member coupled to the leaf spring. The first and second plate assemblies are coupled through the spring assembly. The spring assembly has a first and a second configuration based on whether the railcar is engaged to another railcar. The spring assembly and the second plate assembly can collectively swivel about a centerpoint associated with the pivot member when the spring assembly is in the second configuration and the railcar is in a curved portion of a track.

23 Claims, 10 Drawing Sheets

RAILROAD CAR DIAPHRAGM

CROSS-REFERENCE TO RELATED APPLICATION

This application is based on and derives the benefit of the filing date of U.S. Provisional Patent Application No. 61/147,898, filed Jan. 28, 2009. The entire content of this application is herein incorporated by reference in its entirety.

FIELD

The present invention relates to a diaphragm that encloses the space between the adjoining ends of adjacent railroad cars to provide an enclosed passageway between the adjoining cars, and more particularly, to a diaphragm having a spring mechanism that adjusts to the track on which the railroad cars travel.

BACKGROUND

Diaphragms are structures attached to the ends of adjacent railroad cars (or railcars) to provide an enclosed space between the adjacent railcars that permits passengers to conveniently move from one railcar to the other. Diaphragms protect passengers from the environment and/or from noise when the passengers move between railcars. Moreover, diaphragms are constructed such that they can absorb forces produced by the moving train when, for example, the train is navigating a curve at a relatively high speed. In the past, diaphragms were large, expensive structures with walls of solid resilient material coated with a sealing polymer and contoured to permit expansion, contraction, and/or torsional movement of the diaphragms with respect to each other and with respect to the railcars during movement of the train.

More recently, a diaphragm is typically made of a flexible material, such as a reinforced molded rubber material that surrounds the door of the railcar and at the other end is attached to face plates. This molded rubber material not only protects passengers from the weather and/or from noise, but it can also absorb the forces produced by the moving train during normal train operations. The face plates of adjacent railcars carry wear plates that abut each other when the railcars are engaged. These face plates can be replaced once they wear out, extending the life of the diaphragm. Step or walk plates are also provided over which the passengers can walk when passing through the diaphragm from one railcar to another.

SUMMARY OF THE INVENTION

A railcar diaphragm is described below having a first and a second plate assembly, a bellows assembly, and a spring assembly. The first plate assembly is coupled to a railcar. The second plate assembly is configured to contact another railcar. The bellows is disposed between first and second plate assemblies. The spring assembly includes a leaf spring and a pivot member coupled to the leaf spring. The first and second plate assemblies are coupled through the spring assembly. The spring assembly has a first and a second configuration based on whether the railcar is engaged to another railcar. The spring assembly and the second plate assembly can collectively swivel about a centerpoint associated with the pivot member when the spring assembly is in the second configuration and the railcar is in a curved portion of a track.

DETAILED DESCRIPTION OF SEVERAL EMBODIMENTS

Various embodiments are described below for a diaphragm that provides an enclosed space between adjacent railroad cars that allows convenient movement of passengers between railcars and protects those passengers from the environment and/or noise. This diaphragm includes a spring assembly that absorbs some of the forces typically produced during normal train operations. The spring assembly also allows the diaphragm to adjust to the contour of the track on which the railcar travels.

Figure 1:
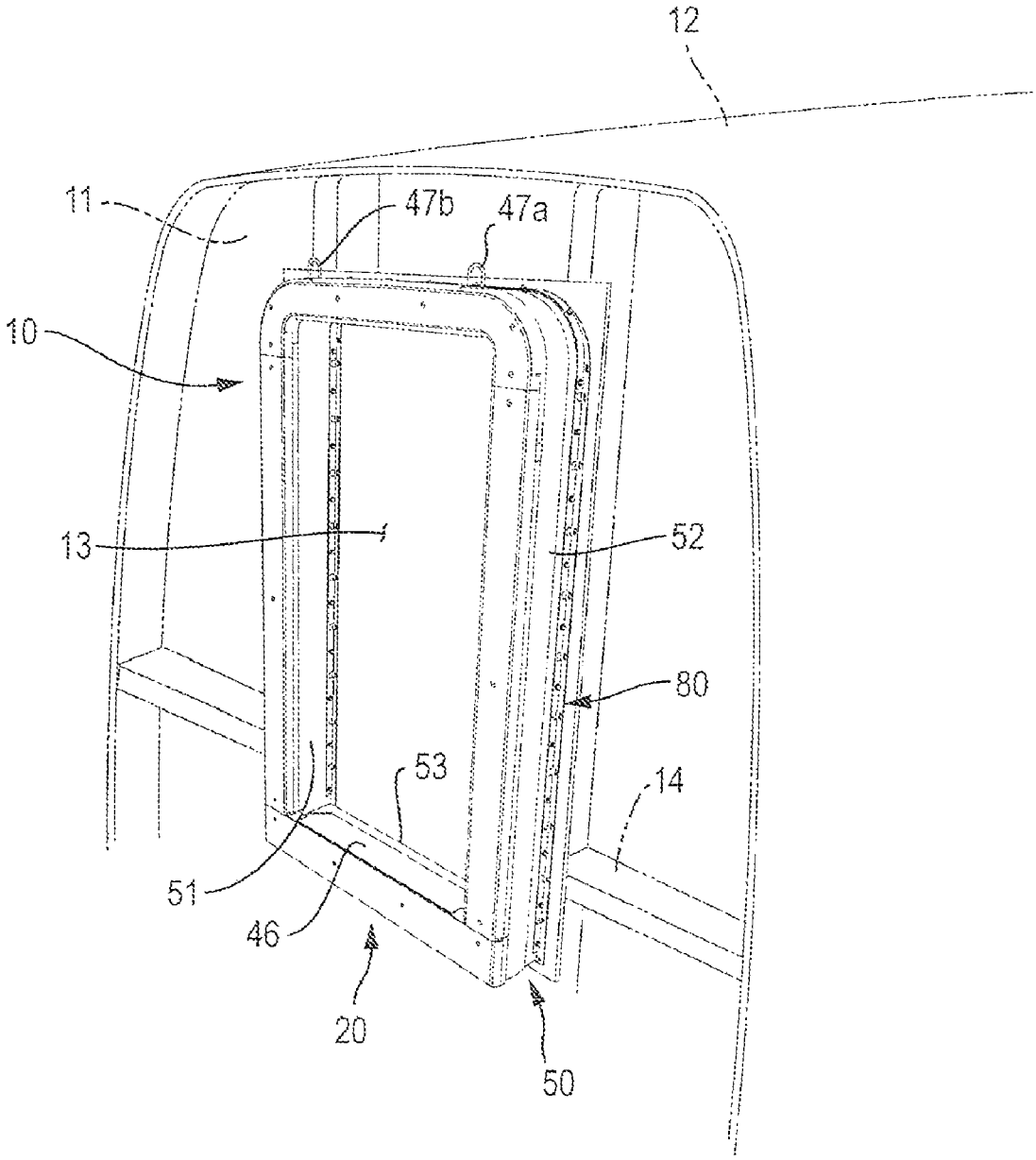
FIG. 1 is a partial perspective view of a railcar having a diaphragm attached to one vertical end of the railcar with the railcar shown in phantom lines, according to an embodiment.

FIG. 1 is a partial perspective view of a railcar 12 having a railcar diaphragm 10 attached to one vertical end wall 11 of the railcar 12, according to an embodiment. The railcar 12 is shown in phantom lines. The diaphragm 10 can be coupled to a portion of the end wall 11 having a doorway 13 such that the diaphragm 10 and another adjacent railcar or diaphragm thereof (not shown) can provide an enclosed space between the adjacent railcars that permits passengers to conveniently move from one railcar to the other while being protected from environmental and/or noise conditions.

The diaphragm 10 includes an anti-friction plate assembly 20, a bellows assembly 50, and a carbody mounting plate assembly 80. The diaphragm 10 also includes a spring assembly (not shown) and vertical bellows support members (not shown). The anti-friction plate assembly 20 abuts the adjacent car or diaphragm thereof when the railcars are engaged or coupled. The anti-friction plate assembly 20 includes a walk plate 46 for passengers to walk over when moving across railcars. The anti-friction plate assembly 20 can include one or multiple mounting rings, such as the mounting rings 47*a* and 47*b*, or the like, that can be used to lift, position and/or remove the diaphragm 10 at the appropriate location to attach the diaphragm 10 to the end wall 11 or to remove the diaphragm 10 from the end wall 11 for replacement or refurbishment.

The bellows assembly 50 provides environmental and/or noise protection to the passengers when moving across the space provided by the adjacent diaphragms. The bellows assembly 50 is made of a flexible fabric having weatherproof properties. For example, the bellows assembly 50 can be made of multiple sections of a silicone-coated fabric, approximately 2.1 millimeters thick, which are sewn and sealed together into a U-shaped configuration. The silicone-coated fabric can have excellent bending characteristics in various types of weather conditions. In some embodiments, the bellows assembly 50 can be made of multiple layers, such as an inner cover and an outer cover, for example.

The bellows assembly 50 includes an outer surface 52 associated with an outer portion of the diaphragm 10 that is in contact with the outside environment and an inner surface 51 associated with an inner portion of the diaphragm 10 that defines at least a portion of the passageway or path through which passengers walk when passing from one railcar to another. The bellows assembly 50 also includes a bottom cover or flap 53 that protects passengers from dirt, water, and/or noise that can originate from below the diaphragm 10 when the train is moving, for example. The walk plate 46 is placed over the flap 53 to provide a rigid structure on the bottom of the passageway on which passengers can walk.

The carbody mounting plate assembly 80 is used to attach or couple the diaphragm 10 to the end wall 11. In the embodiment shown in FIG. 1, the diaphragm 10 is coupled to the end wall 11 by attaching the carbody mounting plate assembly 80 to the exposed beams 14 of the end wall 11 located around the doorway 13. In other embodiments, the diaphragm 10 can be coupled to the end wall 11 by attaching the carbody mounting plate assembly 80 to any structurally-rigid portions of the end wall 11.

Figure 2:
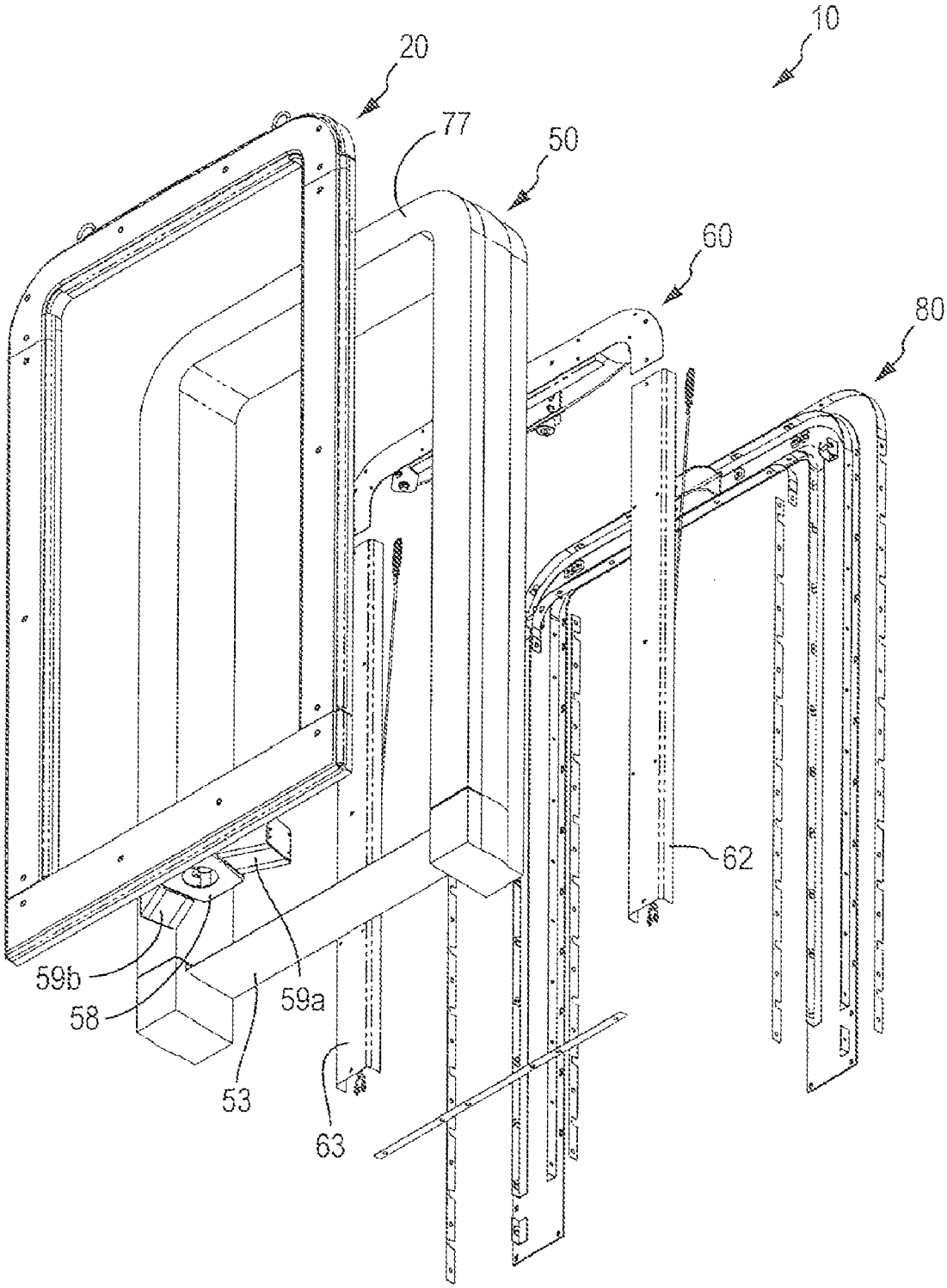
FIG. 2 is an exploded view of a railcar diaphragm, according to an embodiment.

FIG. 2 is an exploded view of the diaphragm 10, according to an embodiment. The diaphragm 10 includes the anti-friction plate assembly 20, the bellows assembly 50, an upper spring assembly 60, a first side vertical bellows support member 62, a second side vertical bellows support member 63, and the carbody mounting plate assembly 80. As shown, the bellows assembly 50 is disposed between the anti-friction plate 20, and the upper spring assembly 60 and the side vertical bellows support members 62 and 63. The upper spring assembly 60 and the side vertical bellows support members 62 and 63 are disposed between the bellows assembly 50 and the carbody mounting plate assembly 80. Once assembled, the upper spring assembly 60 and the side vertical bellows support members 62 and 63 are disposed inside the bellows assembly 50.

Also shown in FIG. 2 are the bottom portions of the anti-friction plate assembly 20 and of the bellows assembly 50. The anti-friction plate assembly 20 includes a support assembly 58 and two rubber isolator mounts 59*a* and 59*b* attached to the support assembly 58. The rubber isolator mounts 59*a* and 59*b* are configured to be attached to support assemblies or structures (not shown) on the bottom portion of the railcar. In another embodiment, a lower spring assembly (not shown), such as a leaf spring assembly, for example, can be used in the lower portion of the diaphragm 10 such that the support assembly 58 and the rubber isolator mounts 59*a* and 59*b* need not be used. The underside of the flap 53 of the bellows assembly 50 is also shown. The flap 53 is offset from the bottom of the bellows assembly 58 such that when the diaphragm 10 is assembled, that is, when the anti-friction plate assembly 20 and the bellows assembly 50 are coupled together, the support assembly 58 and the two rubber isolator mounts 59*a* and 59*b* are positioned below the flap 53.

Figure 3:
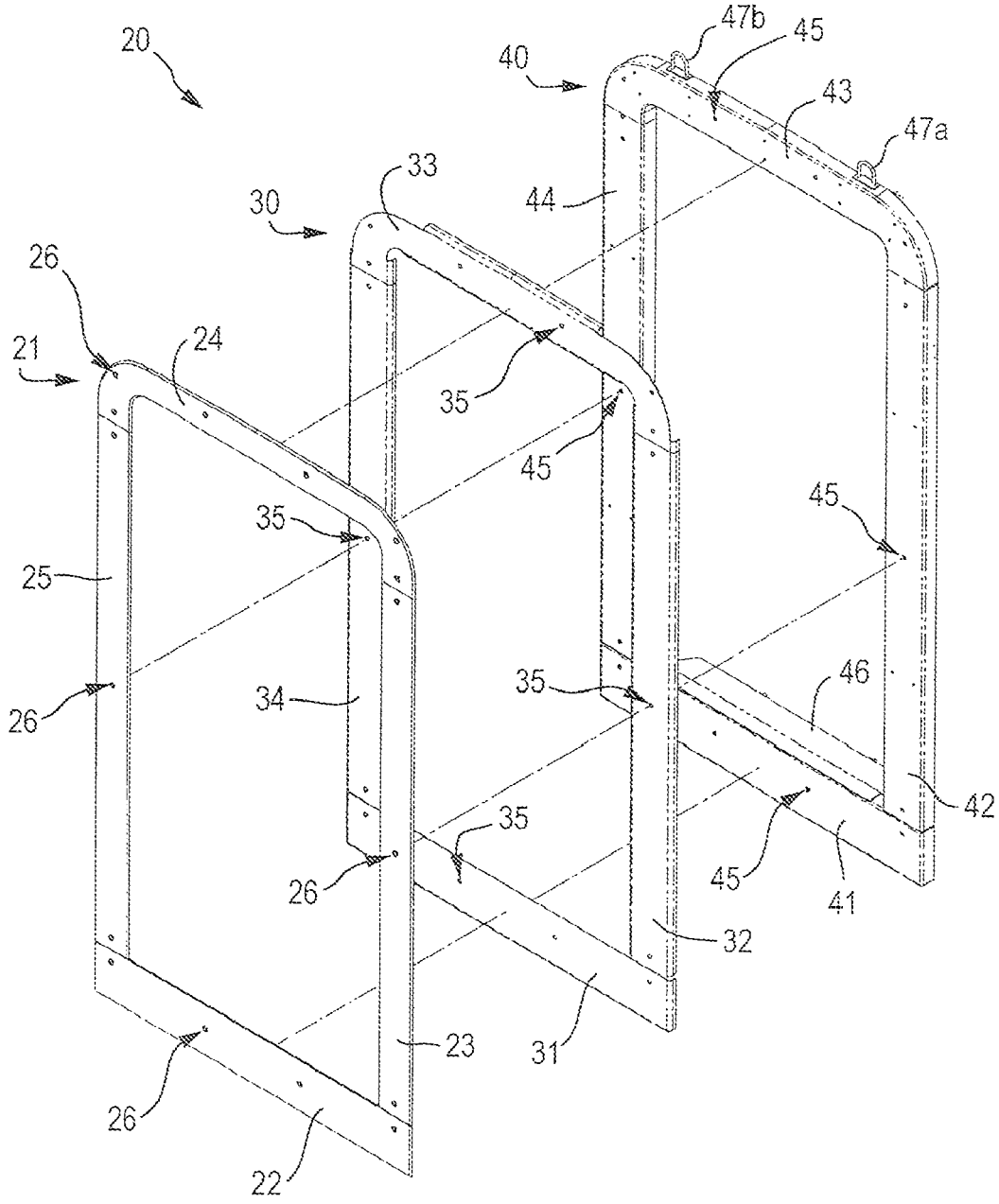
FIG. 3 is an exploded view of the anti-friction plate assembly, according to an embodiment.

FIG. 3 is an exploded view of the anti-friction plate assembly 20, according to an embodiment. The anti-friction plate assembly 20 includes an anti-friction wear plate 21, an anti-friction mounting plate 30, and a bellows face plate assembly 40. Each of the anti-friction wear plate 21, the anti-friction mounting plate 30, and the bellows face plate assembly 40 can include a lower horizontal segment, two side vertical segments, and an arched upper horizontal segment. For example, the anti-friction wear plate 21 can include a lower horizontal segment 22, a side vertical segment 23, an arched upper horizontal segment 24, and a side vertical segment 25. Each of the segments in the anti-friction wear plate 21 can be made of, for example, a phenolic composite with impregnated molybdenum disulfide that is self-lubricating and provides a low coefficient of friction. In another embodiment, the molybdenum disulfide in the phenolic composite can be replaced by another solid lubricant such as graphite, for example, to meet certain operational and/or design requirements, including, but not limited to, smoke, flame, and/or toxicity requirements. The segments of the anti-friction wear plate 21 also include multiple alignment holes 26. In other embodiments, the anti-friction wear plate 21 can include fewer or more segments than those described in FIG. 3.

The anti-friction mounting plate 30 can include a lower horizontal segment 31, a side vertical segment 32, an arched upper horizontal segment 33, and a side vertical segment 34. Each of the segments in the anti-friction mounting plate 30 can be made of stainless steel such as type 304 stainless steel, for example. In another embodiment, the segments the anti-friction mounting plate 30 can be made of aluminum, steel, and/or a fiberglass reinforced plastic composite based on weight and/or strength requirements, for example. The segments of the anti-friction wear plate 21 can be disposed on and attached to corresponding segments of the anti-friction mounting plate 30. For example, the lower horizontal segment 22 of the anti-friction wear plate 21 can be attached to the lower horizontal segment 31 of the anti-friction mounting plate 30 using an adhesive material. Moreover, the side vertical segments 23 and 25 and the arched upper horizontal segment 24 of the anti-friction wear plate 21 can be attached to the side vertical segments 32 and 34 and the arched upper horizontal segment 33 of the anti-friction mounting plate 30, respectively, using an adhesive material, for example. The segments of the anti-friction mounting plate 30 also include multiple alignment holes 35. In other embodiments, the anti-friction mounting plate 30 can include fewer or more segments than those described in FIG. 3.

The bellows face plate assembly 40 can include a lower horizontal segment 41, a side vertical segment 42, an arched upper horizontal segment 43, a side vertical segment 44, and the walk plate 46 attached to the lower horizontal segment 41. Each of the segments of the bellows face plate assembly 40 can be made of stainless steel such as type 304 stainless steel, for example. In another embodiment, the segments the bellows face plate assembly 40 can be made of aluminum, steel, and/or a fiberglass reinforced plastic composite based on weight and/or strength requirements, for example. As shown, the bellows face plate assembly 40 also includes two mounting rings 47*a* and 47*b* coupled to the upper portion of the arched upper horizontal segment 43 for lifting and/or positioning the diaphragm 10 when placing or removing the diaphragm 10 from the railcar 12. The segments of the bellows face plate assembly 40 can be welded together (not shown) and/or coupled together by using multiple fasteners (not shown). The segments of the bellows face plate assembly 40 also include multiple alignment holes 45. As described above with respect to the anti-friction wear plate 21 and the anti-friction mounting plate 30, the bellows face plate assembly 40 can include fewer or more segments than those described in FIG. 3.

The segments of the anti-friction mounting plate 30 having attached segments of the anti-friction wear plate 21 can be disposed on and mated to the corresponding segments or portions of the bellows face plate assembly 40. For example, the lower horizontal segment 31 of the anti-friction mounting plate 30 having attached the lower horizontal segment 22 of the anti-friction wear plate 21 can be disposed on the lower horizontal segment 41 of the bellows face plate assembly 40. The segments of the anti-friction mounting plate 30 can be configured to mate or complement the shape of the segments or portions of the bellows face plate assembly 40. For example, the side vertical segments 32 and 34 of the anti-friction mounting plate 30 can have flanges on either side to mate or complement the shape of the side vertical segments 42 and 44 of the bellows face plate assembly 40.

When a segment of the anti-friction wear plate 21 wears out or is damaged as a result of the typical usage of the diaphragm 10, the worn out segment can be removed and replaced with a new segment. Because each segment of the anti-friction wear plate 21 can be attached (e.g., glued or bonded) to an associated segment of the anti-friction mounting plate 30, replacement or refurbishment of a segment of the anti-friction wear plate 21 may entail removing from the bellows face plate assembly 40 the segment of the anti-friction mounting plate 30 having the worn out or damaged segment from the anti-friction wear plate 21. In such an instance, replacing the worn out or damaged segment from the anti-friction wear plate 21 may require replacing the segment of the anti-friction mounting plate 30 to which it is attached.

The alignment holes 26, 35, and 45 are used to attach or couple the corresponding segments from the anti-friction wear plate 21, the anti-friction mounting plate 30, and the bellows face plate assembly 40. For example, the holes 45 of the bellows face plate assembly 40 can be threaded holes and screws (not shown) can be passed through the holes 26 of the anti-friction wear plate 21 and the holes 35 of the anti-friction mounting plate 30 to fasten the segments of the anti-friction mounting plate 30 having the associated segments of the anti-friction wear plate 21 onto the appropriate segments of the bellows face plate assembly 40.

Figure 4:
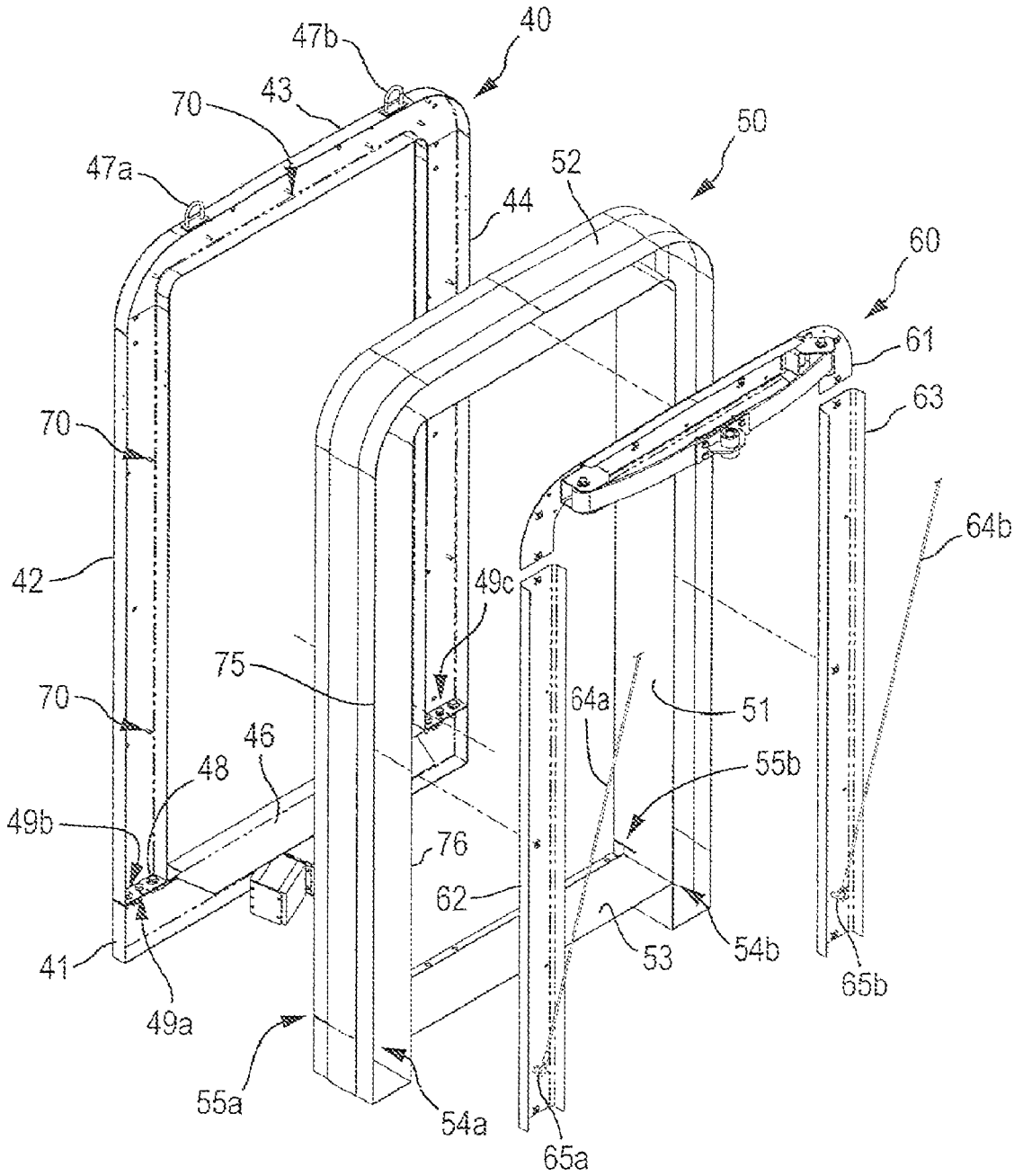
FIG. 4 is an exploded view of a portion of the railcar diaphragm illustrating the placement of the bellows assembly, according to an embodiment.

FIG. 4 is an exploded view of a portion of the diaphragm 10 illustrating the placement of the bellows assembly 50, according to an embodiment. As shown in FIG. 4, the bellows assembly 50 is disposed between the bellows face plate assembly 40 of the anti-friction plate assembly 20, and the upper spring assembly 60 and the side vertical bellows support members 62 and 63. Once assembled, the upper spring assembly 60 and the side vertical bellows support members 62 and 63 are disposed within the U-shaped configuration of the bellows assembly 50.

Also shown in FIG. 4 are flanges 49*a*, 49*b*, and 49*c*. The flange 49*a* runs along an upper portion of the lower horizontal segment 41 of the bellows face plate assembly 40. The flange 49*a* is on the side of the lower horizontal segment 41 opposite the surface of the horizontal lower segment 41 that substantially contacts the lower horizontal segment 31 of the anti-friction mounting plate 30. The center portion of the flange 49*a* is partially covered by the walk plate 46. The flanges 49*b* and 49*c* are located on the lower portion of the side vertical segments 42 and 44 of the bellows face plate assembly 40, respectively. The flanges 49*b* and 49*c* are on the side of the side vertical segments 42 and 44 opposite the surface of the side vertical segments 42 and 44 that substantially contacts the side vertical segments 32 and 34 of the anti-friction mounting plate 30. The side vertical segments 42 and 44 can be coupled to the lower horizontal segment 41 by fastening (e.g., bolting) the flange 49*b* associated with the side vertical segment 42 to one portion of the flange 49*a* and the flange 49*c* associated with the side vertical segment 44 to a different portion of the flange 49*a*. In one example, when the side vertical segments 42 and 44 are bolted to the lower horizontal segment 41, multiple bolts 48 can be used to secure the segments together.

FIG. 4 further shows the configuration of the bellows assembly 50. The bellows assembly 50 can have an inverted U vertical configuration. The bellows assembly can also have a horizontal U-shaped configuration, where the ends 75 and 76 of the "U" in the U-shaped bellows are positioned away from the bellows face plate assembly 40 and the valley 77 (see FIG. 2) of the "U" in the U-shaped bellows is closer to the bellows face plate assembly 40. The outer surface 52 of the bellows assembly 50 associated with the outer portion of the diaphragm 10 corresponds to one of the sides of the "U" in the U-shaped bellows, while the inner surface 51 associated with an inner portion of the diaphragm 10 corresponds to the other side of the "U" in the U-shaped bellows. The bellows assembly 50 includes pockets 54*a* and 54*b* in the lower portion of the bellows assembly 50. Flanges 59*a*, 49*b*, and 49*c* fit within slots 55*a* and 55*b*, also in the lower portion of the bellows assembly 50, through the lower portion of the bellows assembly 50 when the bellows assembly 50 is assembled together with the bellows face plate assembly 40.

FIG. 4 further shows the upper spring assembly 60 having a spring bellows support mounting plate 61, and the side vertical bellows support members 62 and 63. One or more of the components of the upper spring assembly 60 and the side vertical bellows support members 62 and 63 can be made of stainless steel such as type 304 stainless steel, for example. In another embodiment, one or more components of the upper spring assembly 60 and the side vertical bellows support members 62 and 63 can be made of aluminum, steel, and/or a fiberglass reinforced plastic composite based on weight and/or strength requirements, for example. The side vertical bellows support member 62 has a ring or bracket 65*a* on its lower portion to which an end of an elongate member 64*a* (e.g., a wire, string, cable) is coupled. Similarly, the side vertical bellows support member 63 has a ring or bracket 65*b* on its lower portion to which an end of an elongate member 64*b* is coupled. The other end of the elongate members 64*a* (not shown) and of the elongate member 64*b* (not shown) is coupled to an upper portion of the carbody mounting plate assembly 80 as described below with respect to FIG. 5.

The spring bellows support mounting plate 61 of the upper spring assembly 60 can be coupled to the arched upper portion segment 43 of the bellows face plate assembly 40 through an upper portion of the bellows assembly 50. Multiple steel weld studs 70 on the bellows face plate assembly 40 and can be used to attach the spring bellows support mounting plate 61 to the bellows face plate assembly 40. Similarly, the side vertical bellows support members 62 and 63 can be coupled to the side vertical segments 42 and 44 of the bellows face plate assembly 40, respectively, through the vertical portions of the bellows assembly 50. As with the spring bellows support mounting plate 61, the side vertical bellows support members 62 and 63 can be coupled to the side vertical segments 42 and 44 via multiple steel weld studs 70 on the side vertical segments 42 and 44 of the bellows face plate assembly 40.

Figure 5:
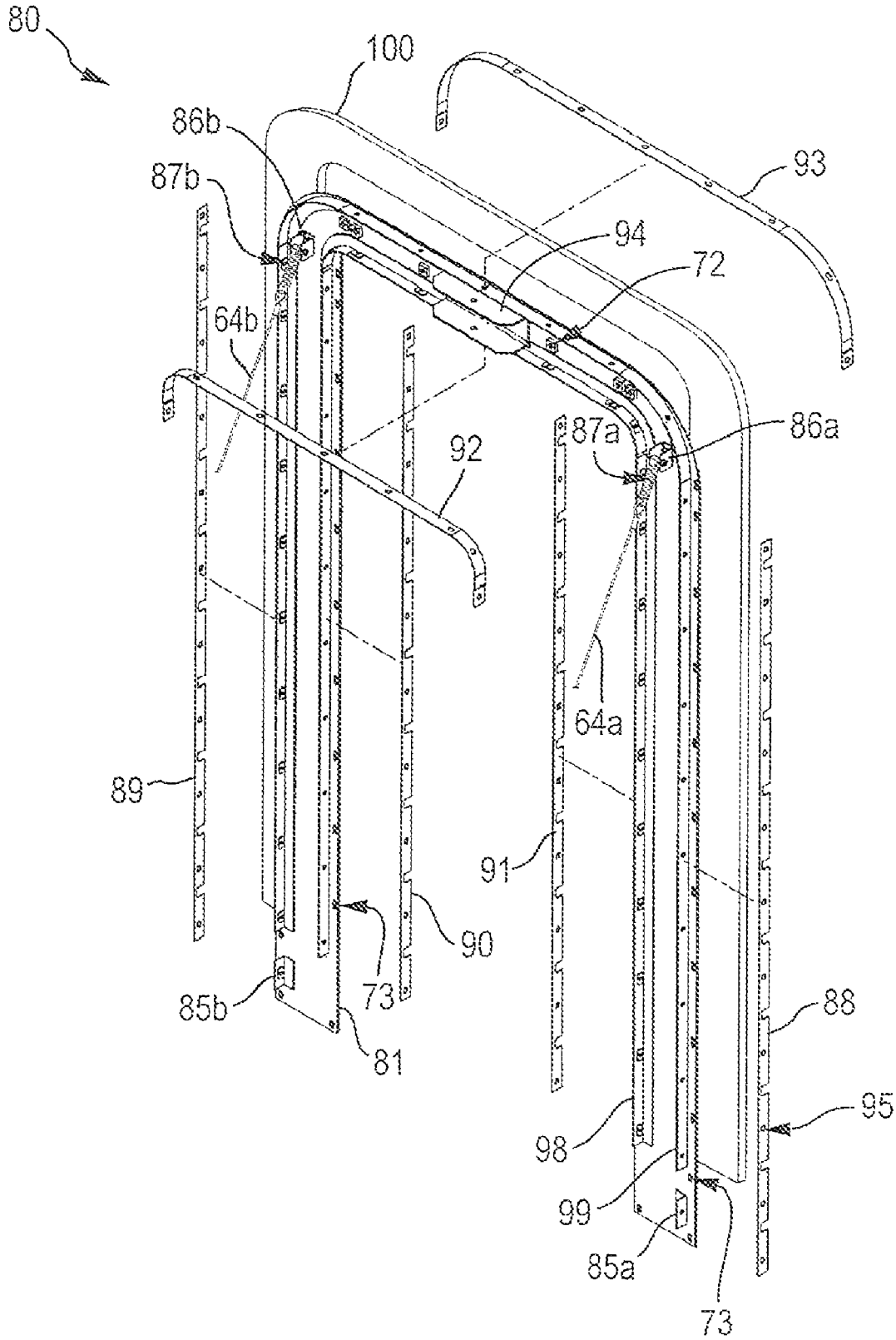
FIG. 5 is an exploded view of the carbody mounting plate assembly, according to an embodiment.

FIG. 5 is an exploded view of the carbody mounting plate assembly 80, according to an embodiment. The carbody mounting plate assembly 80 includes a carbody mounting plate 81 and a center bracket 94 attached to a substantially central location of an arched upper portion of the carbody mounting plate 81. The carbody mounting plate 81 can be made of stainless steel, such as a type 304 stainless steel, for example. In another embodiment, the carbody mounting plate 81 can be made of aluminum, steel, and/or a fiberglass reinforced plastic composite based on weight and/or strength requirements, for example. In a preferred embodiment, the carbody mounting plate 81 is made of a continuous ⅛ inch thick stainless steel plate to allow a sufficient torque setting of the mounting hardware and gasket compression for a watertight seal. The portion of the upper spring assembly 60 opposite the spring bellows support mounting plate 61 is coupled to the center bracket 94 on the carbody mounting plate 81. The carbody mounting plate 81 can be coupled to the end wall 11 of the railcar 12 as shown in FIG. 1 by fastening (e.g., bolting) the carbody mounting plate 81 to the end wall 11 through multiple holes 72 and 73. Associated with the holes 72 can be captive stainless steel nuts, for example.

The carbody mounting plate assembly 80 includes multiple bellows support and mounting strips. For example, a strip 98 on the carbody mounting plate 81 and strips 90, 91, and 92 can be used to attach the ends associated with the inner surface 51 of the bellows assembly 50 to the carbody mounting plate 81. In another example, a strip 99 and brackets 85*a* and 85*b* on the carbody mounting plate 81 and strips 88, 89, and 93 can be used to attach the ends associated with the outer surface 52 of the bellows assembly 50 to the carbody mounting plate 81. Each of the strips described above can have multiple bolt holes 95 that can be used to fasten the bellows assembly 50 to the carbody mounting plate 81. The bellows assembly 50 can be attached to the strips of the carbody mounting plate assembly 80 using stainless steel weld nuts, for example.

The carbody mounting plate assembly 80 further includes brackets 86*a* and 86*b* to which the other end of the elongate members 64*a* and 64*b* described above with respect to FIG. 4 can couple to the carbody mounting plate 81. The elongate member 64*a* can be coupled to the bracket 86*a* through a spring 87*a* or other like component. Similarly, the elongate member 64*b* can be coupled to the bracket 86*b* through a spring 87*b* or other like component. The elongate members 64*a* and 64*b* provide support to the lower portion of the diaphragm 10 by connecting the lower portion of the anti-friction plate assembly 20 through the side vertical bellows support members 62 and 63 with the upper portion of the carbody mounting plate 81.

FIG. 5 also shows a carbody gasket 100 that can be disposed between the carbody mounting plate 81 and the end wall 11 when coupling the diaphragm 10 to the railcar 12. The carbody gasket 100 can be a ¼ inch thick by 3 inches wide silicone gasket, for example.

Figure 6:
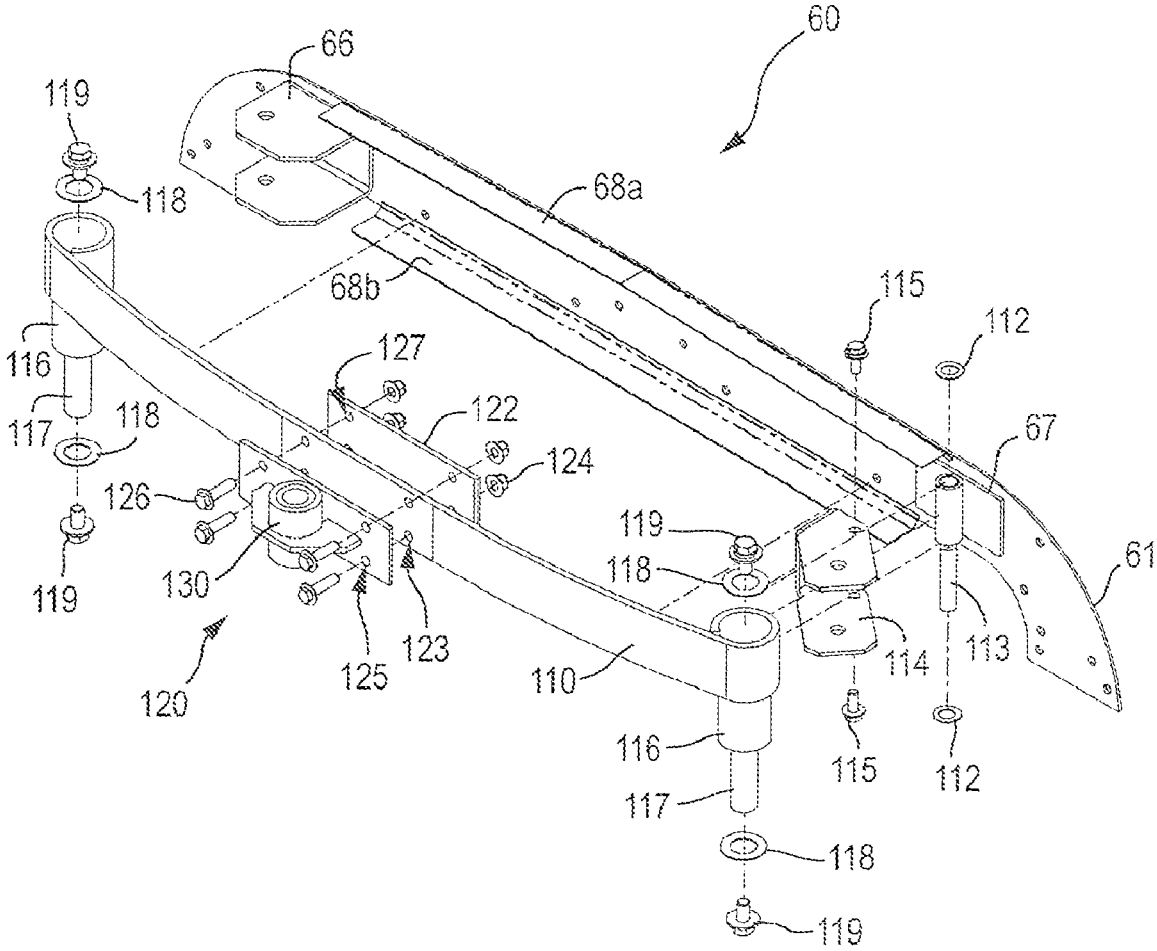
FIG. 6 is an exploded view of the upper spring assembly, according to an embodiment.

FIG. 6 is an exploded view of the upper spring assembly 60, according to an embodiment. The upper spring assembly 60 includes the spring bellows mounting plate 61, a leaf spring 110, and a center pivot bearing assembly 120. The spring bellows mounting plate 61 has a bracket 66 attached to one end and a bracket 67 attached to the other end. The brackets 66 and 67 can be welded to the spring bellows mounting plate 61 or formed integrally therewith, for example. The spring bellows mounting plate 61 further includes a flange 68*a* along an upper portion of the spring bellows mounting plate 61 and a flange 68*b* along a lower portion of the spring bellows mounting plate 61. Coupled to the bracket 67 is an end bracket 114. The bracket 67 is coupled to one end of the end bracket 114 by using a rod 113 that is disposed within the bracket 67. The rod 113 is coupled to the end bracket 114 by using multiple screws 115 and washers 112.

The leaf spring 110 has a first end that is coupled to the bracket 66 and a second end that is coupled to the end bracket 114. The leaf spring 110 is coupled to the bracket 66 through a spring end 116 and a rod 117 using screws 119 and washers 118. The leaf spring 110 is coupled to the end bracket 114 through another spring end 116 and rod 117 using screws 119 and washers 118.

The center pivot bearing assembly 120 is attached to a center portion of the leaf spring 110 and includes a center spring mount plate 122 and a center spring mount bracket 130. The center spring mount plate 122 is located on the side of the leaf spring 110 facing the spring bellows mounting plate 61 and the center spring mount bracket 130 is placed on the opposite side of the leaf spring 110. The center spring mount plate 122 and the center spring mount bracket 130 are attached to the leaf spring 110 and to each other by using multiple screw and washer sets 126 and multiple nut and washer sets 124. The multiple screw and washer sets 126 and multiple nut and washer sets 124 are connected through holes 123, 125, and 127 on the leaf spring 110, the center spring mount bracket 130, and the center spring mount plate 127, respectively.

The center spring mount bracket 130 is coupled to the center bracket 94 attached to the carbody mounting plate 81 such that the upper spring assembly 60, and the anti-friction plate assembly 20 to which it is attached, can both swivel or pivot about a centerpoint associated with the center spring mount bracket 130.

Figure 7A:
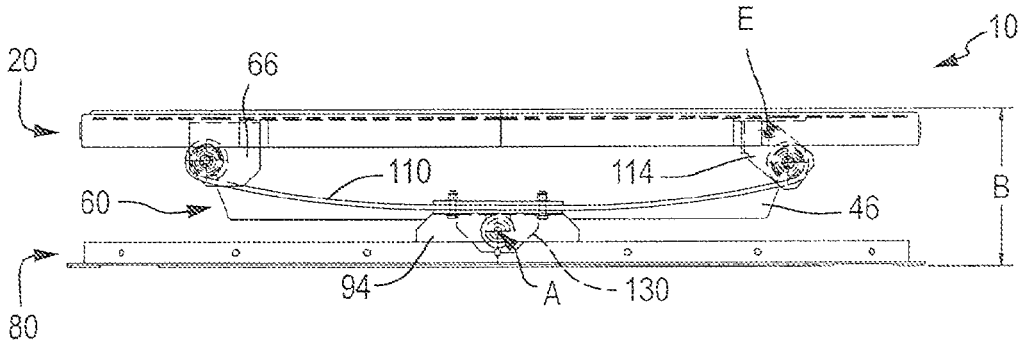
FIGS. 7A-7C are top views illustrating the upper spring assembly when the railcar diaphragm is in an uncoupled position, a coupled position, and a coupled and curved position, respectively, according to an embodiment.
Figure 7B:
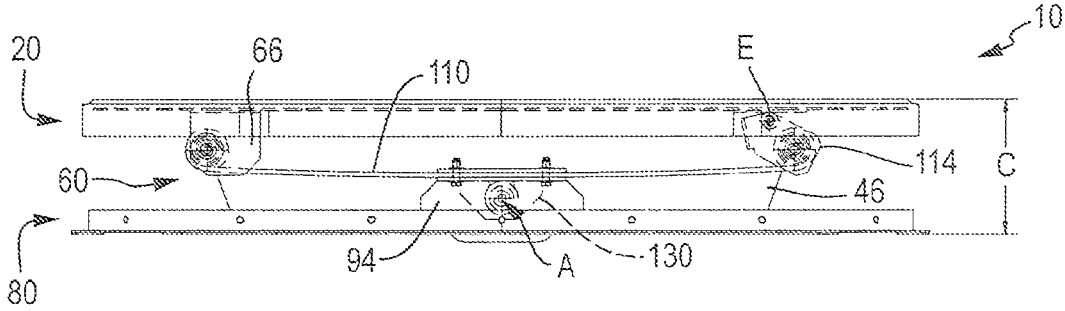
Figure 7C:
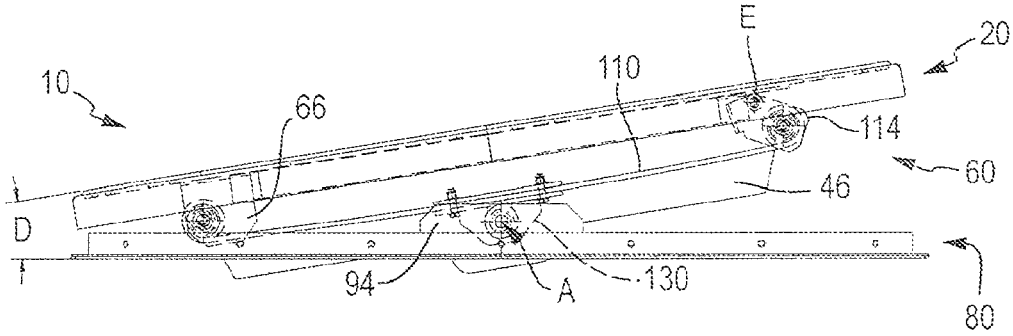

FIGS. 7A-7C are top views illustrating the upper spring assembly 60 when the diaphragm 10 is in an uncoupled position, a coupled position, and a coupled and curved position, respectively, according to an embodiment. FIG. 7A shows a top view of the diaphragm 10 with the bellows assembly 50 removed to show certain internal constructions. The diaphragm 10 is shown when the railcar 12 is in an uncoupled position, that is, the railcar 12 is not engaged or coupled to another railcar. In this position, the upper spring assembly 60 is in a first configuration. In this configuration, the upper spring assembly 60 is positioned away from railcar 12 because there is no force being applied on the anti-friction plate assembly 20 by another railcar. Also shown in FIG. 7A is a centerpoint A common to both the center spring mount bracket 130 and the center bracket 94 attached to the carbody mounting plate 81 of the carbody mounting plate assembly 80.

In one embodiment, when the upper spring assembly 20, and thus the leaf spring 110, is in the configuration of FIG. 7A, a distance B between a portion of the carbody mounting plate assembly 80 that is closest to the end wall 11 of the railcar 12 and a portion of the anti-friction plate assembly 20 that contacts another railcar can have a maximum value of approximately 10 inches, for example. In other embodiments, the distance B may be determined based on a set of design requirements.

Also shown in FIG. 7A is a centerpoint E associated with the end bracket 114 and the bracket 67 (not shown). The end bracket 114 is configured to allow the leaf spring 110 to be substantially uncompressed when the upper spring assembly 60 is in the configuration of FIG. 7A.

FIG. 7B shows the diaphragm 10 when the railcar 12 is in a coupled position, that is, the railcar 12 is engaged or coupled to another railcar. In this position, the upper spring assembly 60 is in a second configuration. In this configuration, the upper spring assembly 60 is closer to railcar 12 because a force is now applied on the anti-friction plate assembly 20 by the adjacent other railcar. The upper portion of the diaphragm 10 is configured to receive a maximum applied force of about 200 pounds to about 300 pounds when the upper spring assembly 60 is in the configuration of FIG. 7B, for example. The amount of applied force that can be received by the upper portion of the diaphragm 10 can be adjusted by, for example, varying the size of the leaf spring 110. The lower portion of the diaphragm 10 is configured to receive a maximum applied force of about 800 pounds to about 1050 pounds when the upper spring assembly 60 is in the configuration of FIG. 7B, for example. The amount of applied force that can be received by the lower portion of the diaphragm 10 can be adjusted by, for example, varying the size of the rubber isolator mounts 59*a* and 59*b* and/or of the pads 56*a* and 56*b*. In another embodiment, when a lower spring assembly (not shown), such as a leaf spring assembly, for example, is used instead of the rubber isolator mounts 59*a* and 59*b* and/or of the pads 56*a* and 56*b*, the amount of applied force that can be received by the lower portion of the diaphragm 10 can be based on the characteristics of the lower spring assembly.

In one embodiment, when the upper spring assembly 20, and thus the leaf spring 110, is in the configuration of FIG. 7B, a distance C between a portion of the carbody mounting plate assembly 80 that is closest to the end wall 11 of the railcar 12 and a portion of the anti-friction plate assembly 20 that contacts the diaphragm of another railcar is between about 7.94 inches and about 8.44 inches, for example. Distance C can be equal to or less than distance B. In other embodiments, the distance C may be determined based on a set of design requirements.

The end bracket 114 can pivot about the centerpoint E to allow the leaf spring 110 to be at least partially compressed when the upper spring assembly 20 is in the configuration of FIG. 7B.

Also shown in FIGS. 7A and 7B is the walk plate 46. When the railcar is in the uncoupled position, the walk plate 46 does not provide a walking platform over the entire distance between the anti-friction plate assembly 20 and the carbody mounting plate assembly 80. When the railcar is in the coupled position, however, the walk plate 46 does provide a walking platform over the entire distance between the anti-friction plate assembly 20 and the carbody mounting plate assembly 80 for passengers to conveniently move between railcars.

FIG. 7C shows the diaphragm 10 when the railcar 12 is in a coupled position, that is, the railcar 12 is engaged or coupled to another railcar, and the railcar 12 is over a curved portion of the track. In this position, the upper spring assembly 60 is in the second configuration. Moreover, the upper spring assembly 60 and the anti-friction plate assembly 20 can collectively swivel, rotate, or pivot about the centerpoint A up to a maximum angle D of about 9 degrees, for example, from a position that is substantially parallel to the carbody mounting plate assembly 80. Said differently, when on a curved portion of the track, a side of the leaf spring 110, and thus of the anti-friction plate assembly 20, is closer to the carbody mounting plate assembly 80 than the other side of the leaf spring 110. In this embodiment, the uneven or angled position of the upper spring assembly 60 may have a maximum angle of about 9 degrees, for example. In other embodiments, the maximum angle supported by the upper spring assembly 60 may be based on a set of design requirements.

Figure 8:
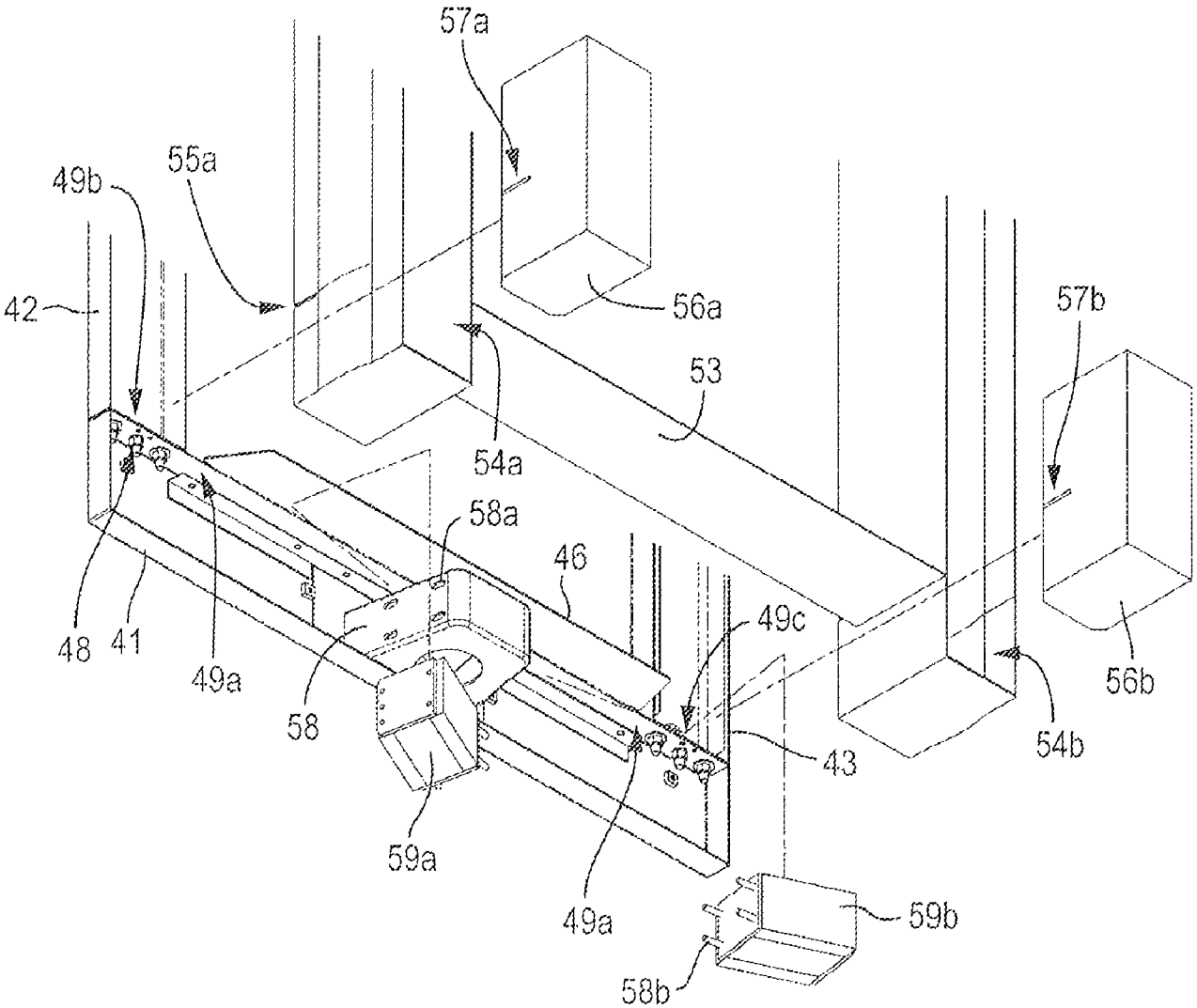
FIG. 8 is an exploded view of a bottom portion of the railcar diaphragm, according to an embodiment.

FIG. 8 is an exploded view of a bottom portion of the railcar diaphragm 10, according to an embodiment. The portion of the anti-friction plate assembly 20 shown in FIG. 8 includes the support assembly 58 and the two rubber isolator mounts 59*a* and 59*b* attached to the support assembly 58. The rubber isolator mounts 59*a* and 59*b* are coupled to the support assembly 58 through multiple holes 58*a* on the support assembly 58 and corresponding screws 58*b* on the rubber isolator mounts 59*a* and 59*b*. Multiple nuts (not shown) can be used to fasten the screws 58*b* to the support assembly 58 through the holes 58*a*. The size of the holes 58*a* on the support assembly 58 can be such that the position of each of the rubber isolator mounts 59*a* and 59*b* is adjustable to appropriately fit the rubber isolator mounts 59*a* and 59*b* between the support assembly 58 and support assemblies or structures on the railcar 12.

When the railcar 12 is in the coupled position described above with respect to FIG. 7B, the rubber isolator mounts 59*a* and 59*b* can be at least partially squeezed or compressed. Moreover, when the railcar 12 is in the coupled position described above with respect to FIG. 7C, one of the rubber isolator mounts 59*a* and 59*b* can be at least partially compressed or squeezed while the other is at least partially uncompressed or expanded based on the manner in which the track curves.

Also shown in FIG. 8 are pads 56*a* and 56*b* that are disposed in the pockets 54*a* and 54*b* of the bellows assembly 50, respectively. The pads 56*a* and 56*b* can be made of silicone, for example. In another embodiment, a lower spring assembly (not shown), such as a leaf spring assembly, for example, can be used in the lower portion of the diaphragm 10 such that the support assembly 58, the rubber isolator mounts 59*a* and 59*b*, and the pads 56*a* and 56*b* need not be used. The pads 56*a* and 56*b* provide additional support to the lower portion of the diaphragm 10 such that the lower portion of the diaphragm 10 can receive a maximum desirable applied force when the railcar 12 is engaged with another railcar. The pad 56*a* has a slot 57*a* that allows the pad 56*a* to fit through the flanges 49*a* and 49*b* when disposed inside the pocket 54*a*. Similarly, the pad 56*b* had a slot 57*b* that allows the pad 56*b* to fit through the flanges 49*a* and 49*c* when disposed inside the pocket 54*b*.

Figure 9:
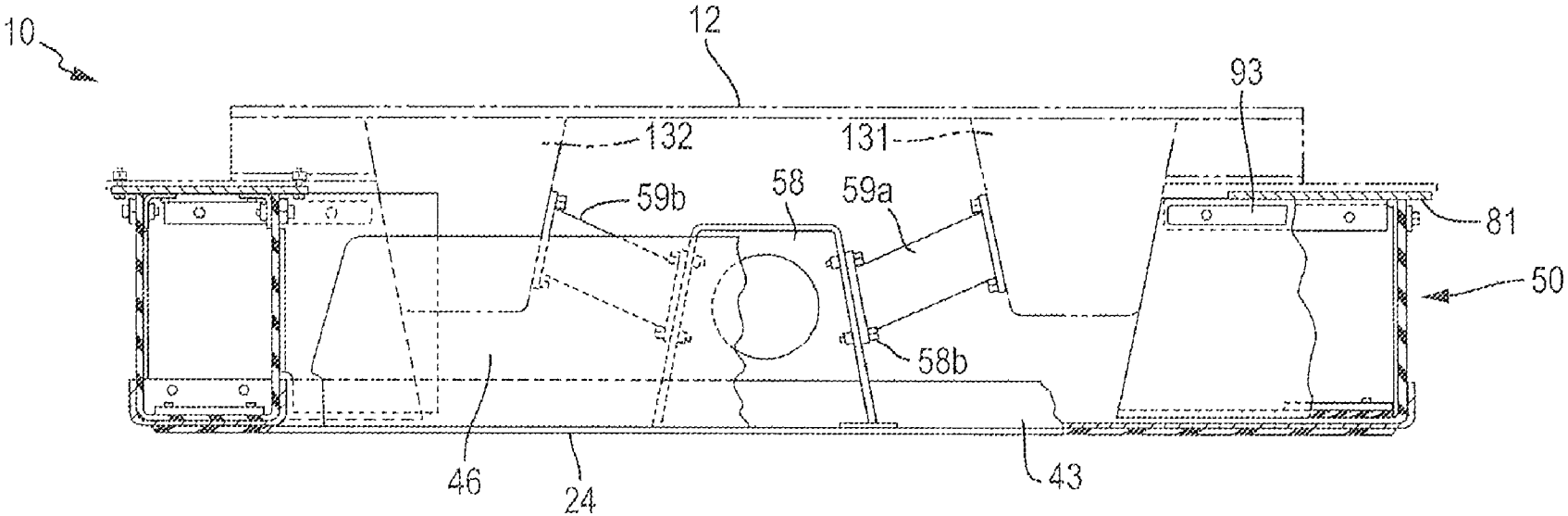
FIG. 9 is a sectional view of the lower portion of the railcar diaphragm and railcar support structures, according to an embodiment.

FIG. 9 is a sectional view of the lower portion of the railcar diaphragm 10 and support structures 131 and 132 of the railcar 12, according to an embodiment. The support assembly 58 is coupled to the support structures 131 and 132 of the railcar 12 through the rubber isolator mounts 59*a* and 59*b*, respectively. As described above, the rubber isolator mounts 59*a* and 59*b* can compress and/or expand based on whether the railcar 12 is coupled or engaged to another railcar and on the curve of the track on which the railcar 12 is located. The rubber isolator mounts 59*a* and 59*b* can be coupled to the support assemblies 131 and 132 through multiple screws 58*b*. Also shown in FIG. 9 is the walk plate 46 positioned over the support assembly 58 to allow passengers to move across railcars.

Figure 10:
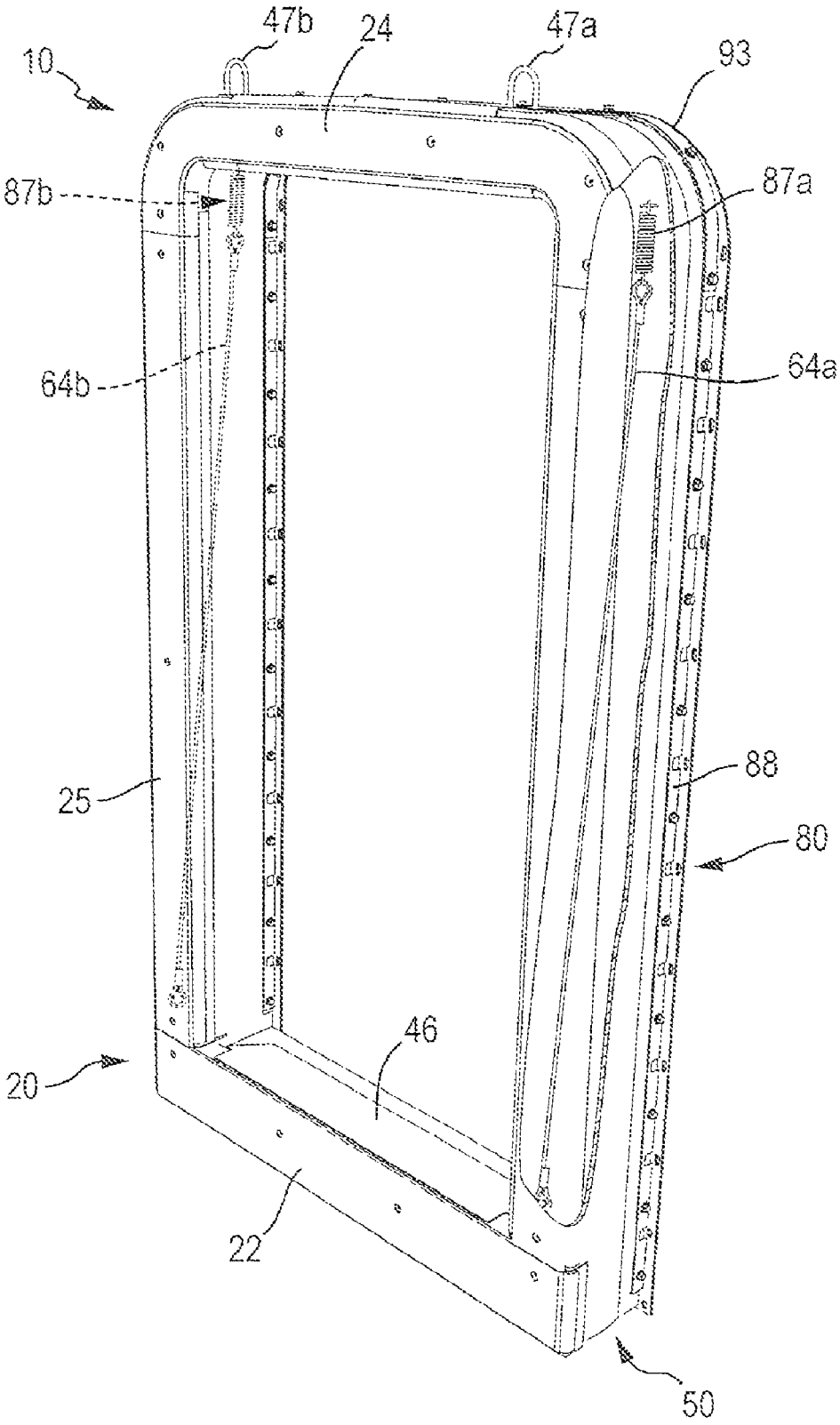
FIG. 10 is a perspective view of the railcar diaphragm with areas removed to show certain internal constructions, according to an embodiment.

FIG. 10 is a perspective view of the railcar diaphragm 10 with areas removed to show certain internal constructions, according to an embodiment. The location and configuration of the first elongate member 64*a* is shown in which one end is coupled to an upper portion of the carbody mounting plate assembly 80 through the spring 87*a*, while the other end is coupled to a lower portion of the anti-friction plate assembly 20 through the side vertical bellows support member 62 (not shown). Similarly, the second elongate member 64*b* is shown in which one end is coupled to an upper portion of the carbody mounting plate assembly 80 through the spring 87*b*, while the other end is coupled to a lower portion of the anti-friction plate assembly 20 through the side vertical bellows support member 63 (not shown). This configuration provides support and/or balance to the lower portion of the anti-friction plate assembly 20. In this embodiment, the springs 87*a* and 87*b* can compress or expand according to the force received and/or the rotation or swiveling that takes place on the diaphragm 10 when the railcar 12 moves along the track.

The various embodiments described above have been presented by way of example, and not limitation. It will be apparent to persons skilled in the art(s) that various changes in form and detail can be made therein without departing from the spirit and scope of the disclosure. In fact, after reading the above description, it will be apparent to one skilled in the relevant art(s) how to implement alternative embodiments. Thus, the disclosure should not be limited by any of the above-described exemplary embodiments.

In addition, it should be understood that the figures are presented for example purposes only. The structures provided in the disclosure are sufficiently flexible and configurable, such that they may be formed and/or utilized in ways other than those shown in the accompanying figures.

What is claimed is:

1. A railcar diaphragm, comprising:

a first plate assembly configured to be coupled to an end wall of a railcar;

a second plate assembly configured to contact another railcar when that other railcar is engaged with the railcar;

a bellows assembly disposed between first plate assembly and the second plate assembly; and a spring assembly including a leaf spring coupled to the second plate assembly and a pivot member coupled to a center portion of the leaf spring, the pivot member being coupled to the first plate assembly, the spring assembly having a first configuration in which the first plate assembly and the second plate assembly are separated by a first distance when the railcar is not coupled to another railcar or a second configuration in which the first plate assembly and the second plate assembly are separated by a second distance less than or equal to the first distance when the railcar is coupled to another railcar, the spring assembly and the second plate assembly configured to collectively swivel about a centerpoint associated with the pivot member when the spring assembly is in the second configuration and the railcar is in a curved portion of a track.

2. The railcar diaphragm of claim 1, wherein the first plate assembly includes a carbody mounting plate and the second plate assembly includes a bellows face plate assembly, the railcar diaphragm further comprising:

a first bellows support member coupled to the bellows face plate assembly of the second plate assembly through a first portion of the bellows assembly;

a second bellows support member coupled to the bellows face plate assembly of the second plate assembly through a second portion of the bellows assembly;

a first elongate member having a first end and a second end, the first end of the first elongate member being coupled to the carbody mounting plate of the first plate assembly, the second end of the first elongate member being coupled to a lower portion of the first bellows support member; and a second elongate member having a first end and a second end, the first end of the second elongate member being coupled to the carbody mounting plate of the first plate assembly, the second end of the second elongate member being coupled to a lower portion of the second bellows support member.

3. The railcar diaphragm of claim 1, wherein the first plate assembly includes a carbody mounting plate and a plurality of bellows mounting strips, at least a portion of the ends of the bellows assembly being attached to the carbody mounting plate with the plurality of bellows mounting strips.

4. The railcar diaphragm of claim 1, wherein the second plate assembly includes a bellows face plate assembly, at least a portion of the bellows assembly being attached to the bellows face plate assembly.

5. The railcar diaphragm of claim 1, wherein:

the spring assembly includes a mounting plate, a first bracket and a second bracket, the mounting plate being coupled to the second plate assembly through a portion of the bellows assembly, the first bracket being attached to a first end portion of the mounting plate, the second bracket being attached to a second end portion of the mounting plate, the first end portion of the mounting plate being opposite from the second end portion of the mounting plate, and the leaf spring has a first end and a second end, the first end of the leaf spring being coupled to the mounting plate through the first bracket, the second end of the leaf spring being coupled to the mounting plate through the second bracket.

6. The railcar diaphragm of claim 5, wherein:

the spring assembly includes a third bracket, the second end of the leaf spring being coupled to the mounting plate through the second bracket and the third bracket.

7. The railcar diaphragm of claim 1, further comprising a gasket disposed between the first plate assembly and the end wall of the railcar having a doorway.

8. The railcar diaphragm of claim 1, further comprising a gasket disposed between the first plate assembly and the end wall of the railcar having a doorway, the gasket being made of silicone.

9. The railcar diaphragm of claim 1, wherein the first plate assembly includes a carbody mounting plate and a center bracket attached to the carbody mounting plate, the center bracket being configured to be coupled to the pivot assembly of the spring assembly such that the spring assembly and the second plate assembly collectively swivel about the centerpoint associated with the pivot assembly of the spring assembly when the leaf spring is in the second configuration and the railcar is in a curved portion of a track.

10. The railcar diaphragm of claim 1, wherein an upper portion of the railcar diaphragm is configured to receive a maximum applied force of about 200 pounds to about 300 pounds when the spring assembly is in the second configuration.

11. The railcar diaphragm of claim 1, wherein a lower portion of the railcar diaphragm is configured to receive a maximum applied force of about 800 pounds to about 1050 pounds when the spring assembly is in the second configuration.

12. The railcar diaphragm of claim 1, wherein a maximum distance between a portion of the first plate assembly that is closest to the end wall of the railcar and a portion of the second plate assembly that contacts the railcar diaphragm of another railcar is approximately 10 inches when the leaf spring is in the first configuration.

13. The railcar diaphragm of claim 1, wherein a minimum distance between a portion of the first plate assembly that is closest to the end wall of the railcar and a portion of the second plate assembly that contacts another railcar is between about 7.94 inches and about 8.44 inches when the leaf spring is in the second configuration.

14. The railcar diaphragm of claim 1, wherein the spring assembly and the second plate assembly are collectively configured to swivel a maximum of about 9 degrees from a position that is substantially parallel to the first plate assembly when the railcar is in a curved portion of the track.

15. The railcar diaphragm of claim 1, wherein the second plate assembly includes a bellows face plate assembly having one or more mounting rings.

16. The railcar diaphragm of claim 1, wherein the bellows assembly includes a plurality of sections, the plurality of sections sawn in such a manner to produce the substantially U-shaped configuration, each section from the plurality of sections being made of a flexible and weather-resistant material.

17. The railcar diaphragm of claim 1, further comprising:

a first rubber pad disposed in a first pocket defined by a lower portion of a first vertical side of the bellows assembly, the first rubber pad being disposed between a lower portion of the second plate assembly and a lower portion of the first plate assembly; and a second rubber pad disposed in a second pocket defined by a lower portion of a second vertical side of the bellows assembly different from the first vertical side of the bellows assembly, the second rubber pad being disposed between a lower portion of the second plate assembly and a lower portion of the first plate assembly.

18. The railcar diaphragm of claim 17, wherein the first rubber pad and the second rubber pad are each made of silicone-based material.

19. The railcar diaphragm of claim 1, wherein:

the second plate assembly includes a wear plate, a mounting plate, and a bellows face plate assembly, and each of the wear plate, the mounting plate, and the bellows face plate assembly of the second plate assembly include a first side vertical segment, a second side vertical segment, a lower horizontal segment, and an arched upper horizontal segment.

20. The railcar diaphragm of claim 1, wherein the bellows assembly has a substantially U-shaped configuration.

21. The railcar diaphragm of claim 1, wherein the spring assembly includes a mounting plate, the mounting plate being coupled to the second plate assembly through a portion of the bellows assembly.

22. The railcar diaphragm of claim 2, further comprising a spring coupling the first elongate member and the carbody mounting plate of the first plate assembly.

23. The railcar diaphragm of claim 2, further comprising a spring coupling the first end of the second elongate member and the carbody mounting plate of the first plate assembly.

* * * * *